US011631948B2

(12) United States Patent
Hirano

(10) Patent No.: US 11,631,948 B2
(45) Date of Patent: Apr. 18, 2023

(54) SEALING MEMBER FOR A WIRE CONNECTED TO A TERMINAL WITHIN A HOUSING

(71) Applicant: SUMITOMO WIRING SYSTEMS, LTD., Mie (JP)

(72) Inventor: Shinji Hirano, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 23 days.

(21) Appl. No.: 17/489,259

(22) Filed: Sep. 29, 2021

(65) Prior Publication Data

US 2022/0109266 A1 Apr. 7, 2022

(30) Foreign Application Priority Data

Oct. 2, 2020 (JP) ..... JP2020-167575

(51) Int. Cl.
*H01R 13/52* (2006.01)

(52) U.S. Cl.
CPC ..... *H01R 13/5205* (2013.01)

(58) Field of Classification Search
CPC ..... H01R 13/5205; H01R 13/5202; H01R 13/521; H01R 13/5208
See application file for complete search history.

(56) References Cited

U.S. PATENT DOCUMENTS 5,571,032 A * 11/1996 Sano ..... H01R 13/5208 439/589
6,241,554 B1 * 6/2001 Murakami ..... H01R 13/506 439/587
6,383,022 B1 * 5/2002 Murakami ..... H01R 13/5208 439/589
7,156,698 B2 * 1/2007 Yamashita ..... H01R 13/5208 439/587
8,568,169 B2 * 10/2013 Akiguchi ..... H01R 13/631 439/589
9,276,352 B2 * 3/2016 Suzuki ..... H01R 13/56

FOREIGN PATENT DOCUMENTS

JP 2014-002978 A 1/2014
JP 2015-191831 A 11/2015

* cited by examiner

*Primary Examiner* — Vanessa Girardi
(74) *Attorney, Agent, or Firm* — Venjuris, P.C.

(57) ABSTRACT

At least one of a housing and a pressing member has an inner peripheral surface to be held in close contact with an outer peripheral surface of a sealing member. The sealing member includes a sealing hole a cable being passed through the sealing hole, and recesses located closer to the outer peripheral surface than the sealing hole and open in at least one of the front and rear surfaces. At least one of the housing and the pressing member includes projections. If, out of an inner wall of the recess, a part located on the side of the outer peripheral surface is an outer lateral part and a part located on the side of the sealing hole s an inner lateral part, a clearance is formed between the projection and the inner lateral part and the projection is arranged in contact with the outer lateral part in the recess.

4 Claims, 9 Drawing Sheets

SEALING MEMBER FOR A WIRE CONNECTED TO A TERMINAL WITHIN A HOUSING

CROSS-REFERENCE TO RELATED APPLICATIONS

This application is based on and claims priority from Japanese Patent Application No. 2020-167575, filed on Oct. 2, 2020, with the Japan Patent Office, the disclosure of which is incorporated herein in their entireties by reference.

TECHNICAL FIELD

The present disclosure relates to a connector.

BACKGROUND

A connector described in Japanese Patent Laid-open Publication No. 2012-129149 includes a terminal (contact) to be connected to a wire, a housing for accommodating the terminal, a sealing member (wire seal) to be mounted into the housing, and a pressing member (outer housing) for restricting the escape of the sealing member from the housing. The sealing member is accommodated into a seal accommodation recess of the housing. The outer peripheral surface of the sealing member is held in close contact with the inner peripheral surface of the seal accommodation recess. The pressing member and the housing include projections (boss pins) projecting toward the sealing member. The sealing member includes a sealing hole (contact insertion hole), through which the wire is passed in a liquid-tight manner, and recesses (pin insertion holes), into which the projections are inserted. In the case of Japanese Patent Laid-open Publication No. 2012-129149, the projections are arranged in the recesses without any clearance in a radial direction. A waterproof connector of this type is also disclosed in Japanese Patent Laid-open Publication Nos.

SUMMARY

In the case of Japanese Patent Laid-open Publication No. 2012-129149, since the projections are held in close contact with the inner peripheral surfaces of the recesses over the entire periphery, resistance is large and there is a concern that workability during mounting is deteriorated. In contrast, if the projections are, for example, arranged in the recesses to have a clearance over the entire periphery, resistance can be reduced, but there is a concern that a positioning function by the fitting of the projections and the recesses is lost.

There is also a concern that the sealing member is deformed by being pressed from the inner peripheral surface of the seal accommodation recess. If the sealing member is deformed in the process of being mounted into the seal accommodation recess and an outer peripheral part thereof is turned over, a problem of reducing sealability arises.

Accordingly, the present disclosure aims to provide a connector excellent in the shape stability and mounting workability of a sealing member.

The present disclosure is directed to a connector with a terminal to be connected to a wire, a housing for accommodating the terminal, a pressing member to be mounted on the housing, and a sealing member to be arranged between the housing and the pressing member, wherein at least one of the housing and the pressing member has an inner peripheral surface to be held in close contact with an outer peripheral surface of the sealing member, the sealing member includes a sealing hole penetrating through front and rear surfaces, the wire being passed through the sealing hole in a liquid-tight manner, and a recess located closer to the outer peripheral surface than the sealing hole, the recess being open in at least one of the front and rear surfaces, at least one of the housing and the pressing member includes a projection to be arranged in the recess, and if, out of an inner wall of the recess in the sealing member, a part located on the side of the outer peripheral surface is an outer lateral part and a part located on the side of the sealing hole is an inner lateral part, a clearance is formed between the projection and the inner lateral part and the projection is arranged in contact with the outer lateral part in the recess.

According to the present disclosure, it is possible to provide a connector excellent in the shape stability and mounting workability of a sealing member.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
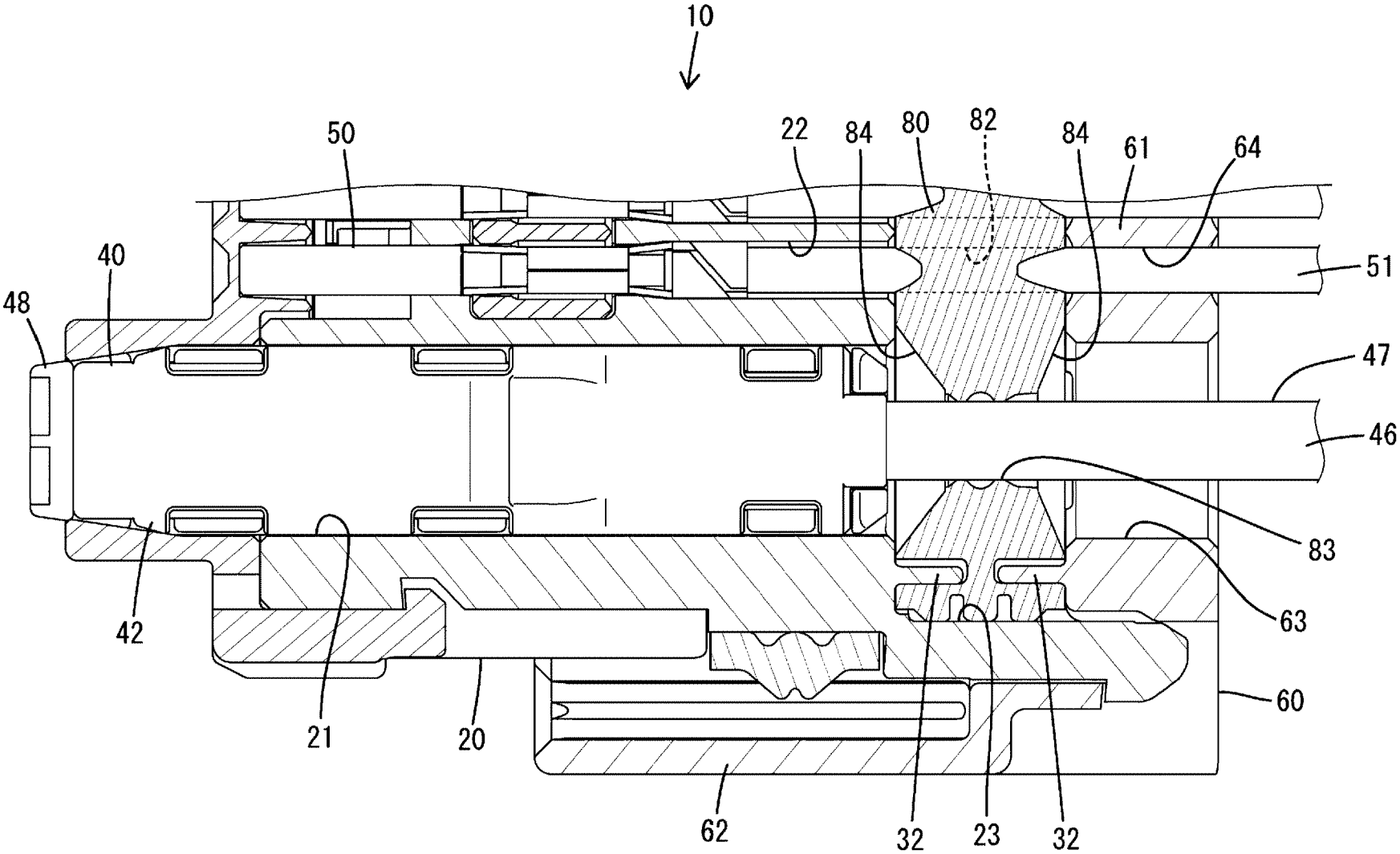
FIG. 1 is a section showing a state where terminals are accommodated in a housing in a connector of a first embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

[Description of Embodiments of Present Disclosure]

First, embodiments of the present disclosure are listed and described.

(1) The connector of the present disclosure includes a terminal to be connected to a wire, a housing for accommodating the terminal, a pressing member to be mounted on the housing, and a sealing member to be arranged between the housing and the pressing member, wherein at least one of the housing and the pressing member has an inner peripheral surface to be held in close contact with an outer peripheral surface of the sealing member, the sealing member includes a sealing hole penetrating through front and rear surfaces, the wire being passed through the sealing hole in a liquid-tight manner, and a recess located closer to the outer peripheral surface than the sealing hole, the recess being open in at least one of the front and rear surfaces, at least one of the housing and the pressing member includes a projection to be arranged in the recess, and if, out of an inner wall of the recess in the sealing member, a part located on the side of the outer peripheral surface is an outer lateral part and a part located on the side of the sealing hole is an inner lateral part, a clearance is formed between the projection and the inner lateral part and the projection is arranged in contact with the outer lateral part in the recess.

According to the above configuration, since the projection is so arranged in the recess that the clearance is formed between the projection and the inner lateral part, resistance (surface pressure) the projection receives from the inner wall of the recess can be reduced in the process of mounting the sealing member into at least one of the housing and the pressing member. Thus, this configuration is excellent in the mounting workability of the sealing member.

On the other hand, since the projection is arranged in the recess to contact the outer lateral part, it can be suppressed that the part of the sealing member on the side of the outer peripheral surface is deformed to be turned over in the process of mounting the sealing member into at least one of the housing and the pressing member. Thus, this configuration is excellent in the shape stability of the sealing member.

(2) The recess may be shaped to extend along two side parts adjacent across a corner part of the sealing member.

According to the above configuration, the clearance formed between the inner lateral part and the projection in the recess can be secured to be long along the two side parts of the sealing member. Thus, when the sealing hole is expanded by the terminal passing therethrough, a deformed part of the sealing member on the side of the outer peripheral surface can be satisfactorily allowed to escape into the above long clearance in the recess. As a result, the mounting workability of the sealing member can be further improved.

(3) The terminal may be a module terminal including an inner conductor to be connected to the wire and a dielectric for covering an outer periphery of the inner conductor.

According to the above configuration, there is a concern that the sealing hole is largely expanded by the module terminal passing therethrough. Thus, the aforementioned advantages given by the excellent mounting workability and shape stability of the sealing member can be sufficiently enjoyed.

(4) A general terminal having smaller external dimensions than the module terminal may be accommodated in the housing and a general wire may be connected to the general terminal, and the sealing member may include a general sealing hole penetrating from the front surface to the rear surface, the general wire being passed through the general sealing hole in a liquid-tight manner.

According to the above configuration, the module terminal and the general terminal are collectively accommodated into one housing and the wire and the general wire are collectively passed through one sealing member. Thus, it is not necessary to individually provide connectors respectively corresponding to the module terminal and the general terminal and an overall structure can be simplified.

[Details of Embodiments of Present Disclosure]

Specific examples of the present disclosure are described below with reference to the drawings. Note that the present invention is not limited to these illustrations and is intended to be represented by claims and include all changes in the scope of claims and in the meaning and scope of equivalents.

First Embodiment

As shown in FIG. 1, a connector 10 includes a housing 20, a module terminal 40 (terminal) to be accommodated into the housing 20, a pressing member 60 to be mounted on the housing 20 and a sealing member 80 arranged to be sandwiched between the housing 20 and the pressing member 60. A plurality of general terminals 50 having smaller external dimensions than the module terminal 40 are also accommodated into the housing 20. Note that, in the following description, a left side of FIG. 1 is referred to as a front side concerning a front-rear direction. A vertical direction is based on a vertical direction of FIG. 1. A lateral direction is based on a lateral direction of FIG. 3.

<Housing>

The housing 20 is made of synthetic resin and connectable to an unillustrated mating housing from front. As shown in FIG. 1, the housing 20 includes one terminal accommodation chamber 21 penetrating in the front-rear direction. The module terminal 40 is inserted and accommodated into the terminal accommodation chamber 21 from behind. The housing 20 also includes a plurality of cavities 22 penetrating in the front-rear direction. The general terminal 50 is inserted and accommodated into each cavity 22 from behind.

Figure 4:
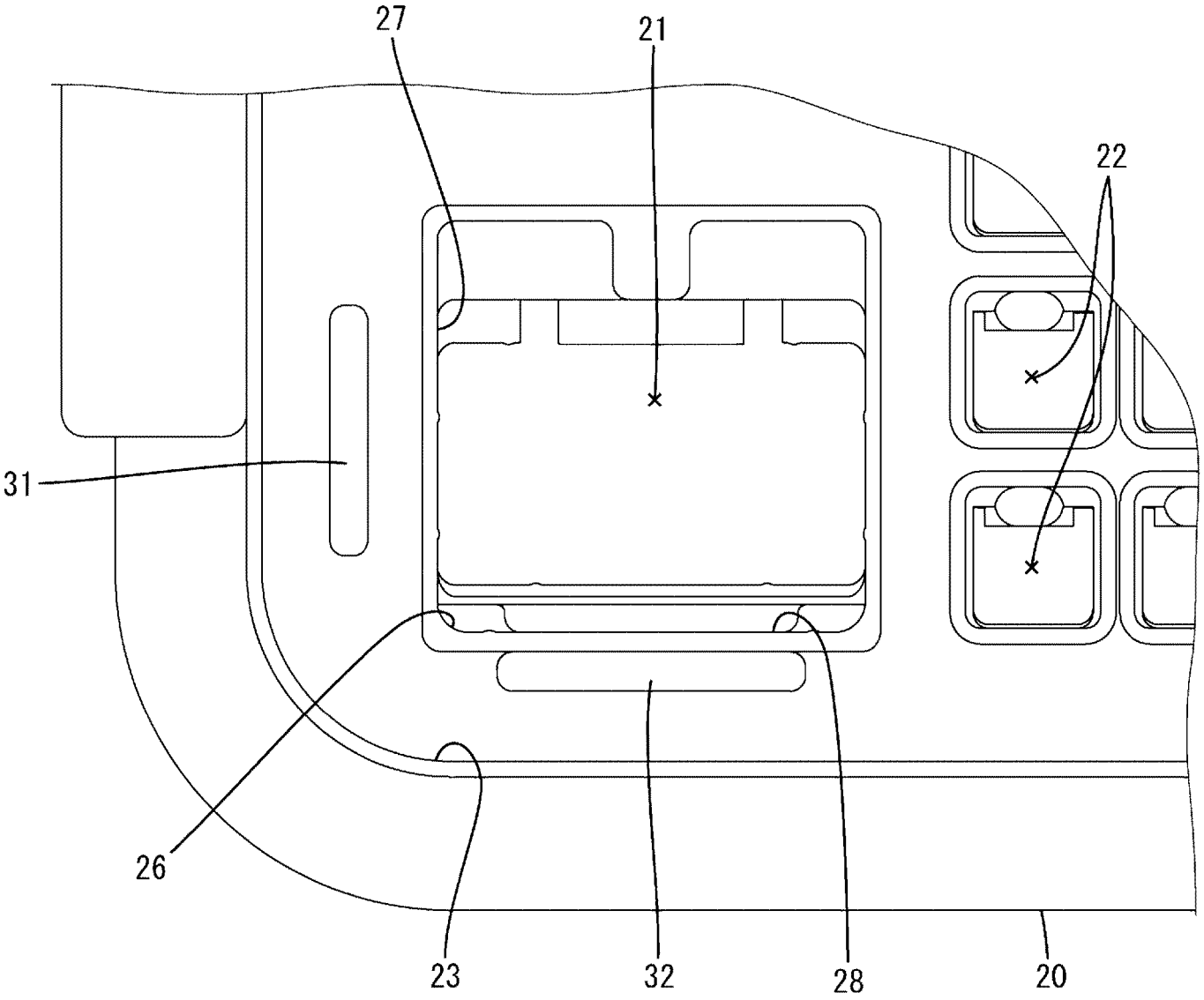
FIG. 4 is an enlarged back view showing a terminal accommodation chamber of the housing and the first and second projections arranged around the terminal accommodation chamber.

As shown in FIG. 4, the terminal accommodation chamber 21 is provided at a position near one corner part of the housing 20 (position on a left-lower corner side in a back view, out of four divided regions of the housing 20 in the back view). The respective cavities 22 are disproportionately provided on one lateral side (right side of FIG. 4) of the housing 20.

The housing 20 includes an accommodation recess 23 open rearward in a rear part. As shown in FIG. 1, the sealing member 80 is inserted and accommodated into the accommodation recess 23 from behind. The accommodation recess 23 is defined by an inner back surface arranged in the vertical direction and lateral direction and an inner peripheral surface connected to the outer peripheral edge of the inner back surface and arranged in the front-rear direction. As shown in FIG. 4, the rear end of each of the terminal accommodation chamber 21 and the cavities 22 is open in the inner back surface of the accommodation recess 23.

As shown in FIG. 4, the rear end of the terminal accommodation chamber 21 has a rectangular opening shape with four rounded corners in a back view and has a larger opening than the rear ends of the respective cavities 22. The rear end of the terminal accommodation chamber 21 includes an inner corner part 26 arched in the back view and two inner side parts 27, 28 adjacent across the inner corner part 26. The respective inner side parts 27, 28 include a first inner side part 27 arranged along the vertical direction and a second inner side part 28 arranged along the lateral direction.

The housing 20 includes two projections 31, 32 projecting rearward from the inner back surface of the accommodation recess 23. Each projection 31, 32 is in the form of a rectangular plate and has such a projection dimension as to be accommodated in the accommodation recess 23. Corner parts of the tip of each projection 31, 32 are rounded (see FIG. 2). As shown in FIG. 4, the respective projections include a first projection 31 in the form of a vertical plate extending long in the vertical direction between an outer peripheral side edge of the accommodation recess 23 and the first inner side part 27 and a second projection 32 in the form of a horizontal plate extending long in the lateral direction along the second inner side part 28 between an outer peripheral lower edge of the accommodation recess 23 and the second inner side part 28.

<Module Terminal>

Figure 5:
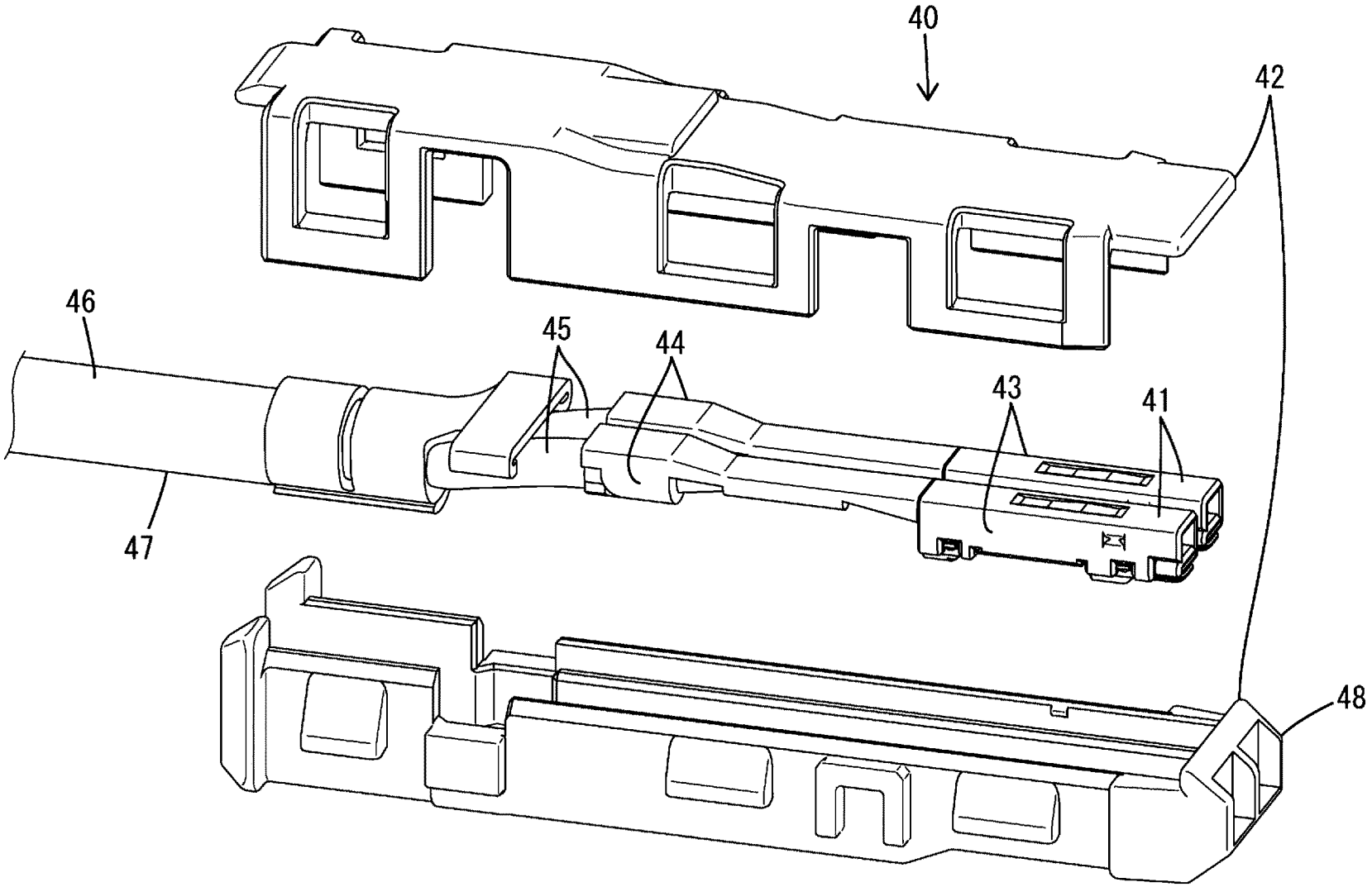
FIG. 5 is an exploded perspective view of a module terminal.

The module terminal 40 is a terminal for high-speed communication and includes, as shown in FIG. 5, a pair of inner conductors 41 and separable and unitable upper and lower dielectrics 42 for accommodating the respective inner conductors 41. The respective inner conductors 41 are made of conductive metal and arranged side by side in the lateral direction in the dielectrics 42. The inner conductor 41 includes a tubular connecting portion 43 and a crimping portion 44 in the form of an open barrel connected to the rear end of the connecting portion 43. A front end part of a conductive wire 45 (coated wire) is connected to the crimping portion 44. A pair of the conductive wires 45 connected to the respective inner conductors 41 constitute a cable 46 as a twisted pair cable. The outer periphery of the cable 46 is collectively covered by an insulating sheath 47. The lower dielectric 42 includes a guide inclined portion 48 having a trapezoidal shape tapered toward a front end in a side view and a bottom view.

<General Terminals>

The general terminal 50 is a general female terminal fitting and integrally formed, such as by bending a conductive metal plate. As shown in FIG. 1, the external dimensions of the general terminal 50 are smaller than those of the module terminal 40. The general terminal 50 is connected to a general wire 51 (coated wire) for transmitting a signal having a lower frequency than a high-frequency circuit of the aforementioned cable 46. An outer diameter of the general wire 51 is smaller than that of the cable 46.

<Pressing Member>

Figure 6:
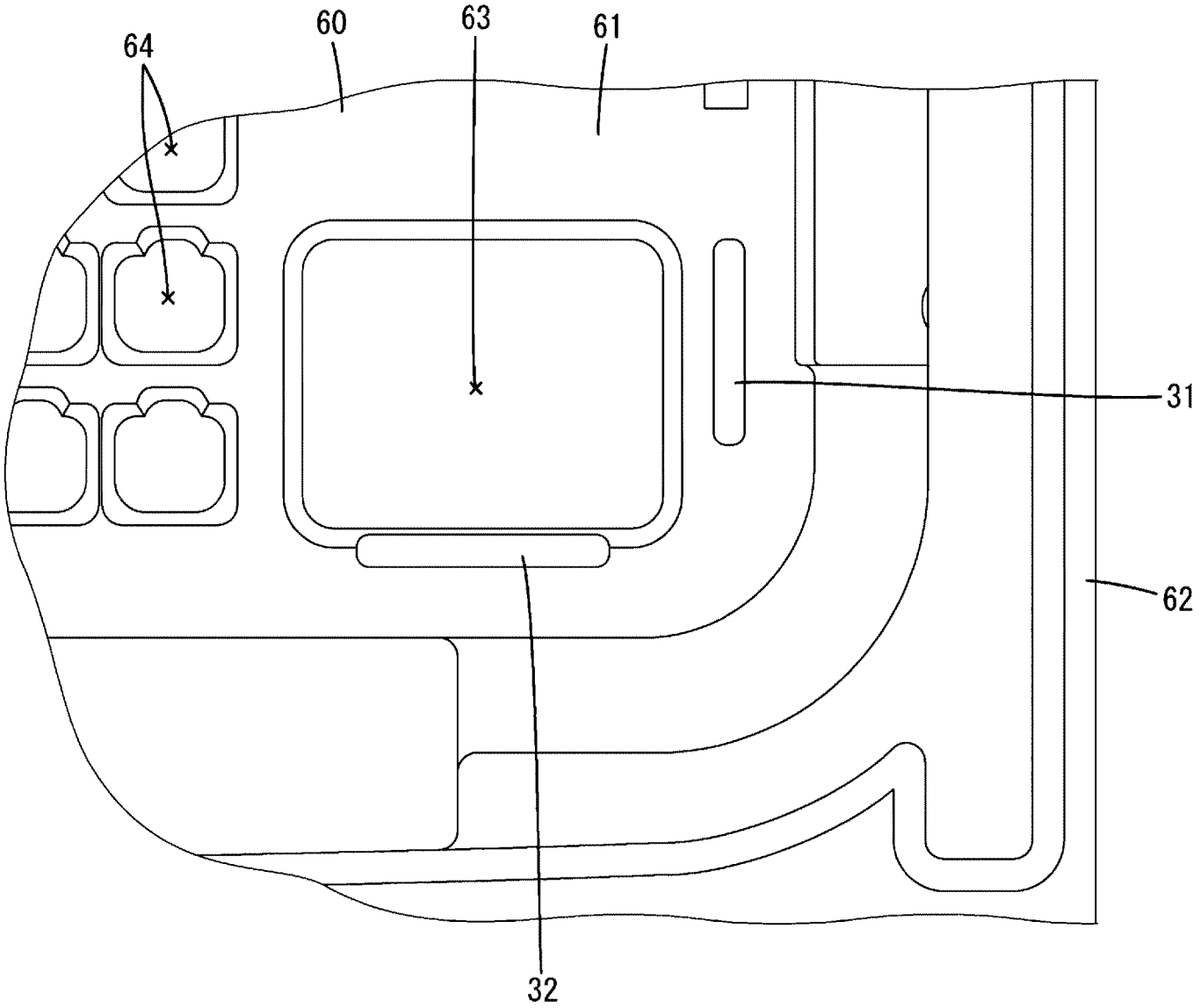
FIG. 6 is an enlarged front view showing a terminal through hole of the pressing member and the first and second projections arranged around the terminal through hole when viewed from the side of the housing.

The pressing member 60 is made of synthetic resin and cap-shaped and includes, as shown in FIGS. 1 and 6, a plate-like pressing wall portion 61 arranged along the vertical direction and a plate-like peripheral wall portion 62 projecting forward from the outer peripheral edge of the pressing wall portion 61. Unillustrated lock portions are provided on both left and right sides of the pressing wall portion 62. The respective lock portions are locked to the housing 20, whereby the pressing member 60 is held on the housing 20.

As shown in FIG. 1, the pressing wall portion 61 faces the sealing member 80 accommodated in the accommodation recess 23 and restricts the rearward escape of the sealing member 80. The pressing wall portion 61 includes one terminal through hole 63 and a plurality of through holes 64.

As shown in FIG. 6, the terminal through hole 63 is provided at a position near one corner part of the pressing wall portion 61 (position on a right-lower corner side in a front view, out of four divided regions of the pressing wall portion 61 in the front view). The respective through holes 64 are disproportionately provided on one lateral side (left side of FIG. 6) of the pressing wall portion 61.

Two projections 31, 32 are provided to project forward on the front surface of the pressing wall portion 61. The respective projections are shaped similarly to the respective projections 31, 32 provided on the housing 20 and include a first projection 31 in the form of a vertical plate extending long in the vertical direction and a second projection 32 in the form of a horizontal plate extending long in the lateral direction. The first and second projections 31, 32 are respectively arranged along two sides of a rectangular opening in the front end of the terminal through hole 63. Note that the same reference signs (first projection 31, second projection 32) are given to the respective projections in each of the pressing member 60 and the housing 20.

<Sealing Member>

Figure 2:
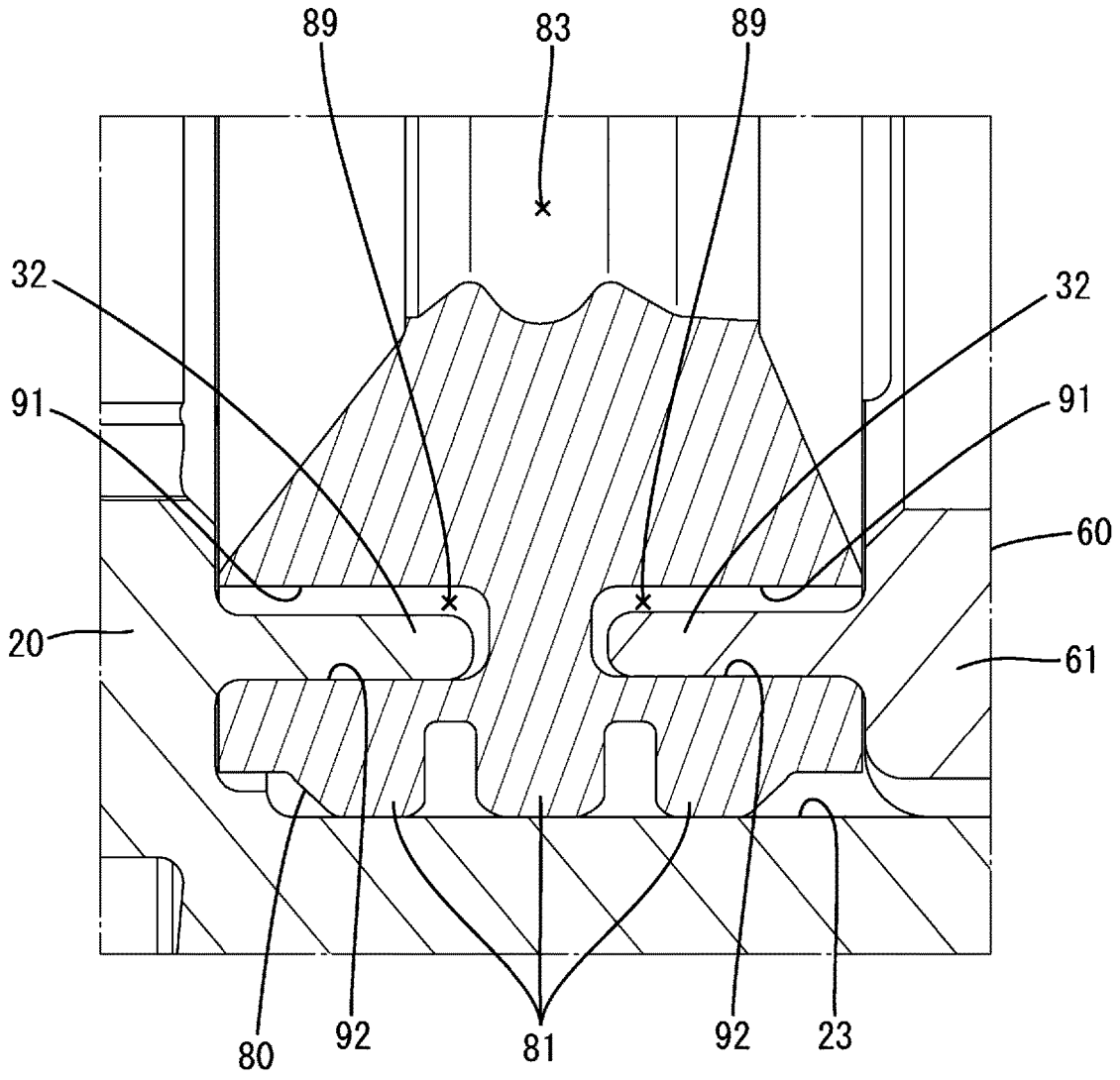
FIG. 2 is an enlarged side view in section showing a state where a second projection of the housing is inserted in a second recess on a front surface side of a sealing member and a second projection of a pressing member is inserted in a second recess on a rear surface side of the sealing member.

The sealing member 80 is made of rubber such as silicon rubber and in the form of a plate (mat) having a thickness in the front-rear direction. As shown in FIG. 2, a plurality of outer peripheral lips 81 are provided to project on the outer peripheral surface of the sealing member 80. The respective outer peripheral lips 81 are provided side by side in the front-rear direction on the outer peripheral surface of the sealing member 80. The respective outer peripheral lips 81 are held in close contact with the inner peripheral surface of the accommodation recess 23.

Figure 7:
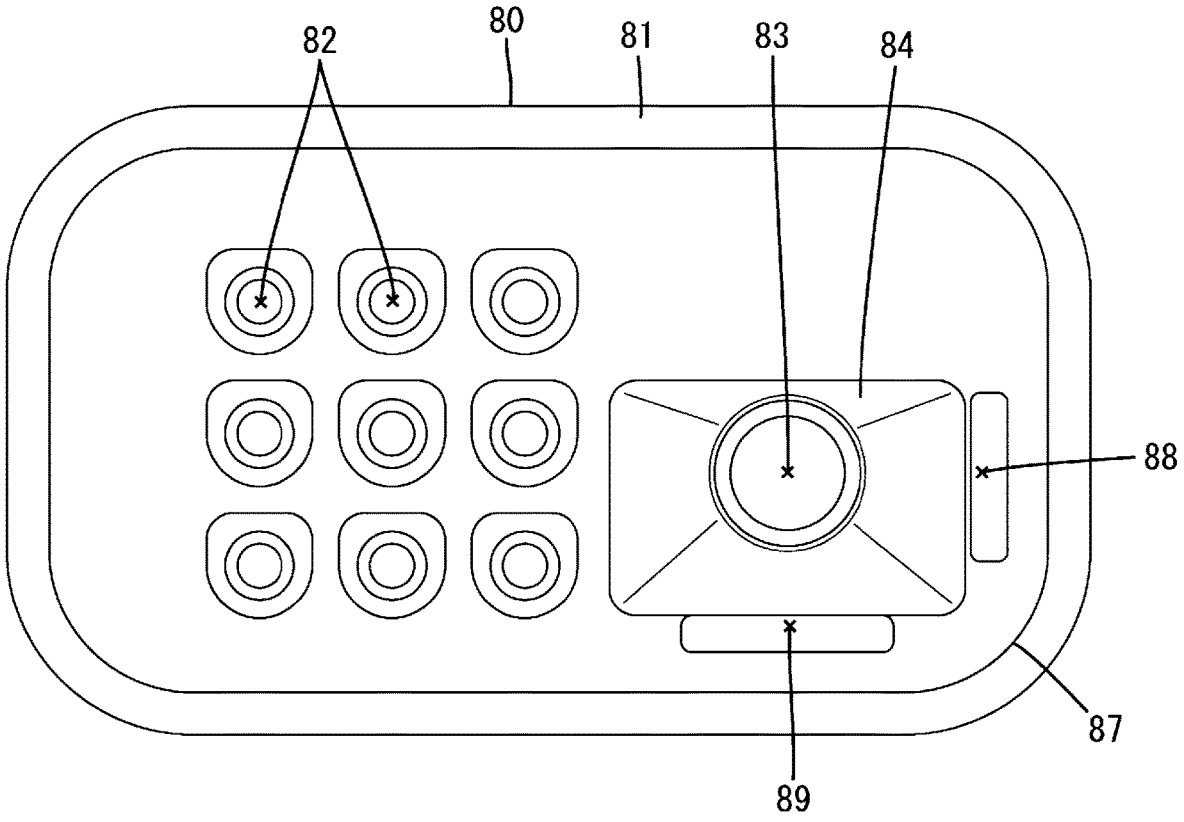
FIG. 7 is a front view of the sealing member.

As shown in FIG. 1, the front surface of the sealing member 80 is facing in contact with the inner back surface of the accommodation recess 23. The rear surface of the sealing member 80 is facing in contact with the front surface of the pressing wall portion 61. As shown in FIG. 7, the sealing member 80 includes a plurality of general sealing holes 82. The respective general sealing holes 82 penetrate through the front and rear surfaces of the sealing member 80 and communicate with the respective cavities 22 and the respective through holes 64 (see FIG. 1). The respective general sealing holes 82 are aligned and arranged in the vertical direction and lateral direction in a region on one lateral side (left side of FIG. 7) of the sealing member 80.

Further, the sealing member 80 includes one sealing hole 83 penetrating through front and rear surfaces at a position near one corner part 87 (position on a right-lower corner side in a front view, out of four divided regions of the sealing member 80 in the front view). The sealing hole 83 communicates with the terminal accommodation chamber 21 and the terminal through hole 63 (see FIG. 1).

The general sealing holes 82 and the sealing hole 83 respectively have a circular cross-section as shown in FIG. 7, and the general wires 51 and the cable 46 are inserted therethrough as shown in FIG. 1. The inner peripheral surface of each general sealing hole 82 and the inner peripheral surface of the sealing hole 83 have lips to be held in close contact with the outer peripheral surface of each general wire 51 and the outer peripheral surface of the cable 46. An inner diameter of the sealing hole 83 is larger than that of each general sealing hole 82.

As shown in FIG. 1, a guiding portion 84 widened forward from the front end of the sealing hole 83 is provided in the front surface of the sealing member 80. As shown in FIG. 7, the guiding portion 84 is defined by a rectangular outer edge long in the lateral direction in a front view. The sealing hole 83 is eccentrically arranged above a center of the guiding portion 84 in the front view.

Figure 8:
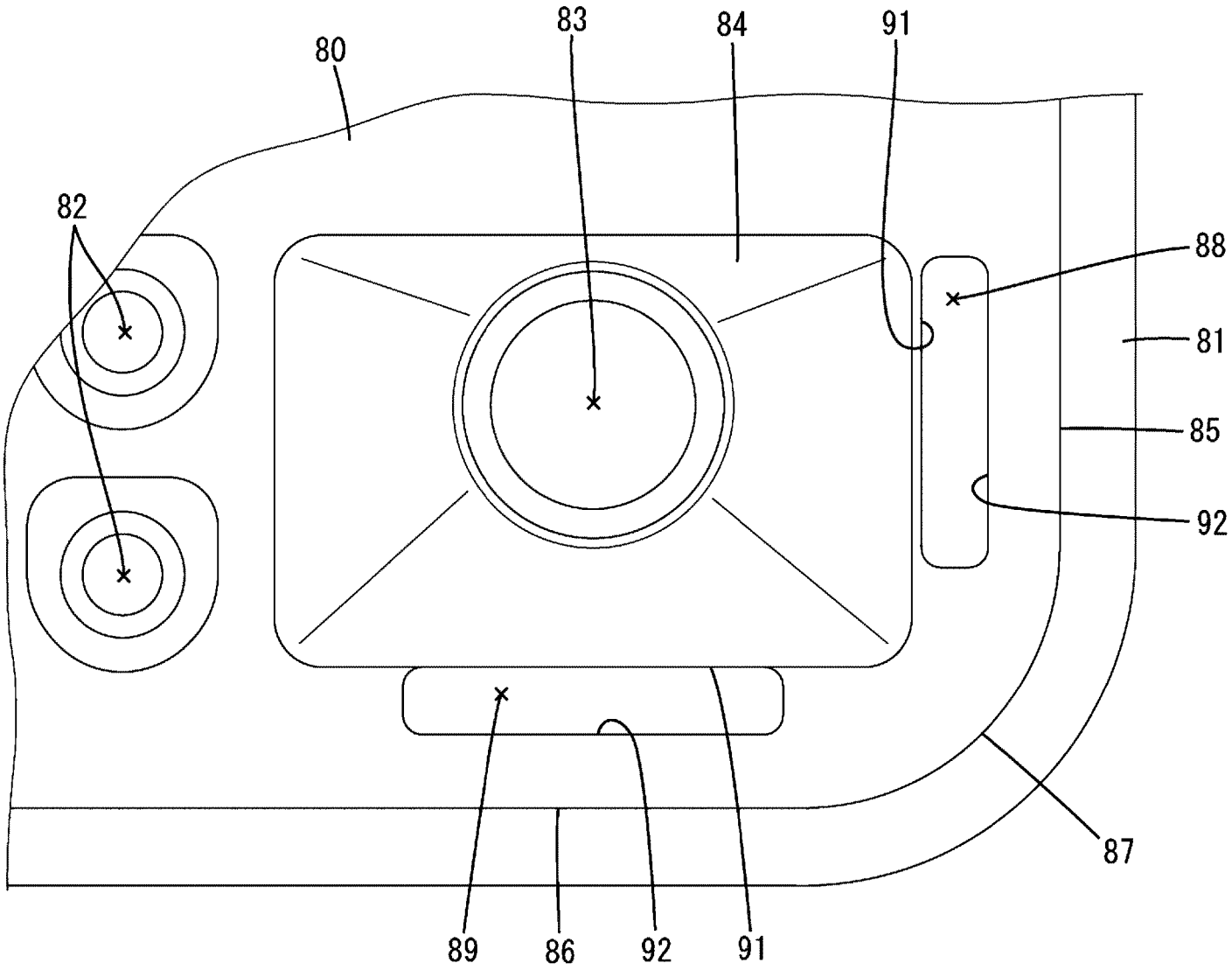
FIG. 8 is an enlarged front view showing a sealing hole of the sealing member and the first and second recesses arranged around the sealing hole.

As shown in FIG. 8, the one corner part 87 of the sealing member 80 is arcuately curved in the front view. As shown in FIG. 8, the outer peripheral surface of the sealing member 80 has two outer side parts 85, 86 adjacent across the one corner part 87. Each outer peripheral lip 81 is included in the respective outer side parts 85, 86 and the one corner part 87.

The respective outer side parts 85, 86 include a first outer side part 85 arranged along the vertical direction and a second outer side part 86 arranged along the lateral direction. The sealing member 80 includes two recesses 88, 89 open in the front surface. The respective recesses 88, 89 are slit-like bottomed recesses extending in the vertical direction and lateral direction and having a back end (rear end) in a front half of the sealing member 80 in a thickness direction (see FIG. 2).

Figure 3:
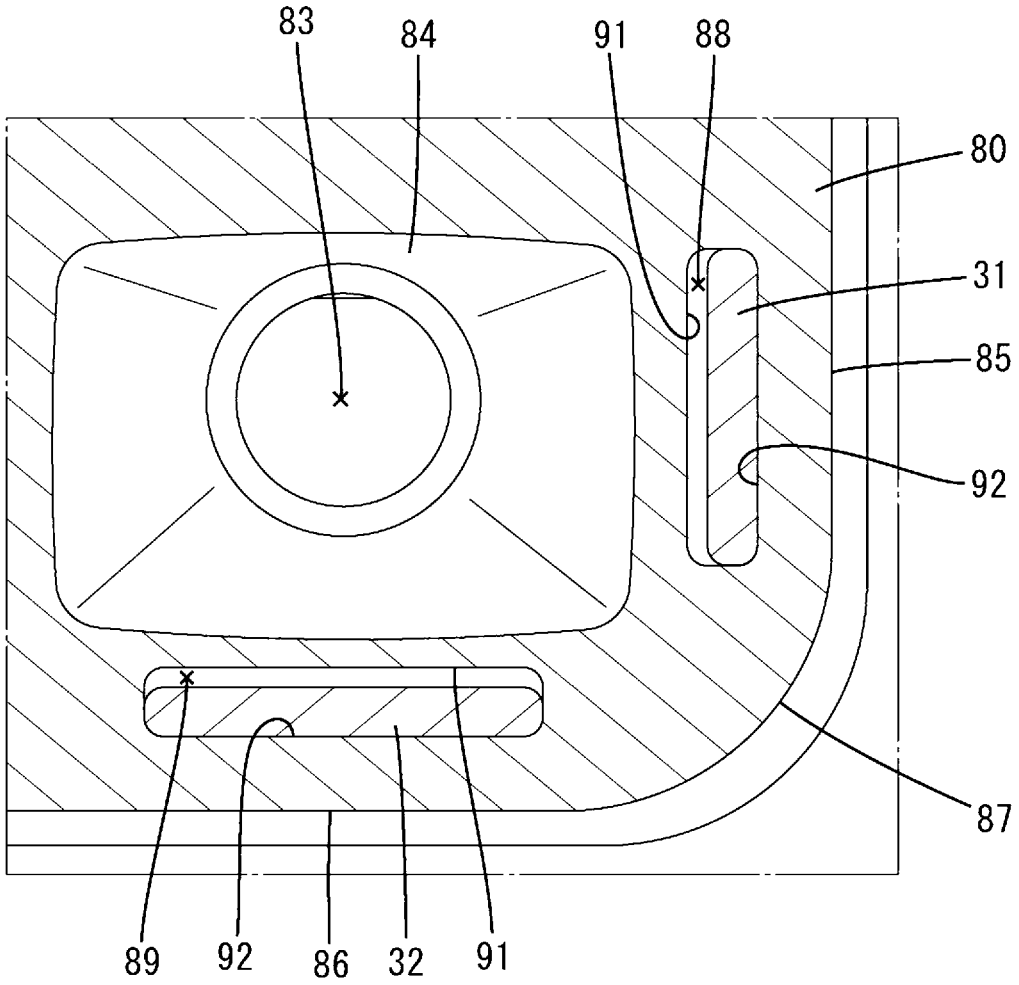
FIG. 3 is an enlarged front view in section showing a state where a first projection and the second projection of the housing are inserted in a first recess and the second recess on the front surface side of the sealing member.

The respective recesses 88, 89 include a vertical slit-like first recess 88 extending long in the vertical direction between one side edge (right side edge of FIG. 8) of the guiding portion 84 and the first outer side part 85 and a horizontal slit-like second recess 89 extending long in the lateral direction along the lower side edge of the guiding portion 84 between the lower side edge of the guiding portion 84 and the second outer side part 86. As shown in FIG. 3, the first projection 31 of the housing 20 is inserted into the first recess 88 and the second projection 32 of the housing 20 is inserted into the second recess 89.

A length in the lateral direction of the second recess 89 is longer than a length in the vertical direction of the first recess 88. The sealing hole 83 is located lateral to the first recess 88 and arranged in a length range of the first recess 88 in the vertical direction. Further, the sealing hole 83 is located above the second recess 89 and arranged in a length range of the second recess 89 in the lateral direction.

As shown in FIG. 8, the inner wall of the first recess 88 has an inner lateral part 91 and an outer lateral part 92 facing parallel to each other in the lateral direction in long side parts along the vertical direction. The inner lateral part 91 is arranged on one side edge side (side of the sealing hole 83) of the guiding portion 84, and the outer lateral part 92 is arranged on the side of the first outer side part 85 (outer peripheral surface side of the sealing member 80). Similarly, the inner wall of the second recess 89 has an inner lateral part 91 and an outer lateral part 92 facing parallel to each other in the vertical direction in long side parts along the lateral direction. The inner lateral part 91 is arranged on the lower side edge side (side of the sealing hole 83) of the guiding portion 84, and the outer lateral part 92 is arranged on the side of the second outer side part 86 (outer peripheral surface side of the sealing member 80).

The sealing member 80 includes a guiding portion 84 and two recesses 88, 89 also in the rear surface. The guiding portion 84 and the respective recesses 88, 89 on the rear surface side have the same shapes as the guiding portion 84 and the respective recesses 88, 89 on the front surface side described above. That is, the respective recesses 88, 89 include a vertical slit-like first recess 88 and a horizontal slit-like second recess 89 and include an inner lateral part 91 and an outer lateral part 92 on an inner peripheral surface. The first projection 31 of the pressing member 60 is inserted into the first recess 88 and the second projection 32 of the pressing member 60 is inserted into the second recess 89. The respective recesses 88, 89 on the front and rear surface sides of the sealing member 80 are symmetrically arranged back-to-back on both front and rear sides across a center in the thickness direction of the sealing member 80 (see FIG. 2).

As shown in FIG. 3, in each recess 88, 89, a distance between the inner lateral part 91 and the outer lateral part 92 is larger than a thickness of each projection 31, 32. Specifically, in the case of the first recess 88, a lateral distance between the inner lateral part 91 and the outer lateral part 92 is larger than a lateral thickness of the first projection 31. In the case of the second recess 89, a vertical distance between the inner lateral part 91 and the outer lateral part 92 is larger than a vertical thickness of the second projection 32. Thus, the projections 31, 32 are inserted into the respective recesses 88, 89 with clearances formed therebetween.

<Overall Structure of Connector>

The sealing member 80 is inserted into the accommodation recess 23 of the housing 20 from behind. In the process of inserting the sealing member 80, the outer peripheral surface of the sealing member 80 slides in contact with the inner peripheral surface of the accommodation recess 23. As shown in FIG. 3, one flat surface (surface facing rightward in FIG. 3) of the first projection 31 of the housing 20 is in contact with the outer lateral part 92 of the first recess 88 on the front surface side of the sealing member 80 to suppress the deformation of the outer lateral part 92 of the first recess 88. Similarly, one flat surface (surface facing downward in FIG. 3) of the second projection 32 of the housing 20 is in contact with the outer lateral part 92 of the second recess 89 on the front surface side of the sealing member 80 to suppress the deformation of the outer lateral part 92 of the second recess 89. In this way, the deformation of each outer side part 85, 86 of the sealing member 80 is also suppressed and, consequently, it can be avoided that the outer peripheral surface of the sealing member 80 is turned over.

Further, in the process of inserting the sealing member 80, a clearance is formed between the other flat surface (surface facing leftward in FIG. 3) of the first projection 31 of the housing 20 and the inner lateral part 91 of the first recess 88 on the front surface side of the sealing member 80. Similarly, a clearance is formed between the other flat surface (surface facing upward in FIG. 3) of the second projection 32 of the housing 20 and the inner lateral part 91 of the second recess 89 on the front surface side of the sealing member 80. Thus, an increase of insertion resistance of the sealing member 80 into the accommodation recess 23 of the housing 20 can be suppressed.

Subsequently, the pressing member 60 is mounted on the housing 20. In the process of mounting the pressing member 60, one surface of the first projection 31 of the pressing member 60 contacts the outer lateral part 92 of the first recess 88 on the rear surface side of the sealing member 80 to suppress the deformation of the outer lateral part 92 of the first recess 88. Similarly, one surface of the second projection 32 of the pressing member 60 contacts the outer lateral part 92 of the second recess 89 on the rear surface side of the sealing member 80 to suppress the deformation of the outer lateral part 92 of the second recess 89.

Further, in the process of mounting the pressing member 60, a clearance is formed between the other surface of the first projection 31 of the pressing member 60 and the inner lateral part 91 of the first recess 88 on the rear surface side of the sealing member 80. Similarly, a clearance is formed between the other surface of the second projection 32 of the pressing member 60 and the inner lateral part 91 of the second recess 89 on the rear surface side of the sealing member 80. Thus, an increase of mounting resistance of the pressing member 60 onto the housing 20 can be suppressed. In this way, the front and rear surfaces of the sealing member 80 are held in close contact with the inner back surface of the accommodation recess 23 and the front surface of the pressing wall portion 61 and the sealing member 80 is held to be sandwiched between the housing 20 and the pressing member 60.

Subsequently, the module terminal 40 is inserted from the terminal through hole 63 into the terminal accommodation chamber 21 via the sealing hole 83. When the module terminal 40 passes through the sealing hole 83, the guide inclined portion 48 of the module terminal 40 slides in contact with the guiding portion 84 in the rear surface of the sealing member 80 and is guided and inserted into the sealing hole 83. Since the respective projections 31, 32 are in contact with the outer lateral parts 92 of the respective recesses 88, 89, position fluctuations of the sealing hole 83 in the sealing member 80 are suppressed. As a result, the module terminal 40 is smoothly inserted into the sealing hole 83. If the module terminal 40 is properly inserted into the terminal accommodation chamber 21 as shown in FIG. 1, the cable 46 is held in close contact with the inner peripheral surface of the sealing hole 83 to seal around the cable 46 in a liquid-tight manner.

Thereafter, each general terminal 50 is inserted from the through hole 64 into the cavity 22 via the general sealing hole 82. If each general terminal 50 is properly inserted into the cavity 22, the general wire 51 is held in close contact with the inner peripheral surface of the general sealing hole 82 to seal around the general wire 51 in a liquid-tight manner.

As described above, according to the first embodiment, the sealing member 80 is provided with the recesses 88, 89, and the outer lateral part 92 and the inner lateral part 91 are provided on the inner wall of each recess 88, 89. With the respective projections 31, 32 of the housing 20 and the pressing member 60 inserted in the respective recesses 88, 89, the clearances are formed between the inner lateral parts 91 of the respective recesses 88, 89 and the respective projections 31, 32. Thus, resistance (surface pressure) each projection 31, 32 receives from the inner wall of each recess 88, 89 can be reduced. In contrast, the outer lateral parts 92 of the respective recesses 88, 89 and the respective projections 31, 32 are arranged in contact with each other. Thus, it can be suppressed that parts of the sealing member 80 on the outer peripheral surface side are deformed to be turned over. Therefore, the connector 10 of the first embodiment is excellent in the mounting workability and shape stability of the sealing member 80.

Further, the recesses include the first and second recesses 88, 89 extending long along the two outer side parts 85, 86 adjacent across the one corner part 87 in the back view and front view of the sealing member 80. Thus, long clearances can be secured between the inner lateral parts 91 of the respective recesses 88, 89 and the respective projections 31, 32, and deformed parts of the sealing member 80 on the outer peripheral surface side can be efficiently allowed to escape into those long clearances in the process of mounting the sealing member 80. As a result, the mounting workability of the sealing member 80 can be further improved.

Further, in the case of the first embodiment, the plurality of general terminals 50 having smaller external dimensions than the module terminal 40 are accommodated into the housing 20, and the respective general wires 51 connected to the respective general terminals 50 are inserted into the respective general sealing holes 82 of the sealing member 80 in a liquid-tight manner. In this way, the module terminal 40 and the respective general terminals 50 are collectively accommodated into one housing 20 and the cable 46 and the respective general wires 51 are collectively inserted through one sealing member 80, whereby the overall structure of the connector 10 can be simplified.

Second Embodiment

Figure 9:
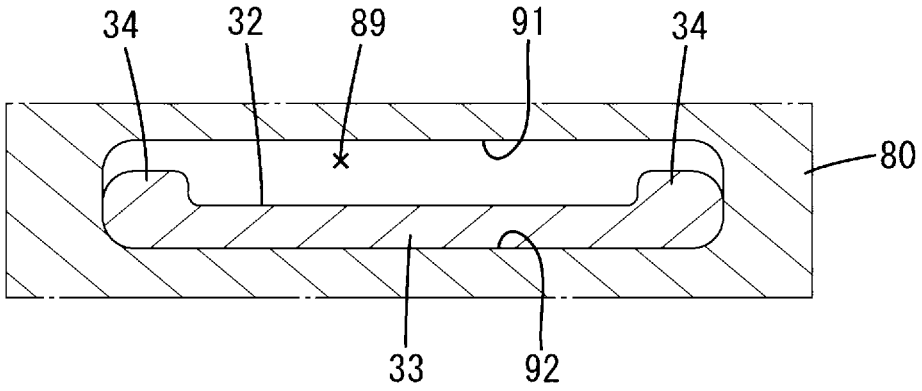
FIG. 9 is an enlarged front view in section showing a state where a second projection of a housing is inserted in a second recess on a front surface side of a sealing member in a connector of a second embodiment of the present disclosure.

A second embodiment is different from the first embodiment in the shapes of respective projections 31, 32 provided on a housing 20 and a pressing member 60. Note that FIG. 9 shows a state where the second projection 32 of the housing 20 is inserted in a second recess 89 on a front surface side of a sealing member 80.

Each projection 31, 32 includes a body portion 33 in the form of a rectangular plate and a pair of ribs 34 rising from both left and right ends of the body portion 33. The ribs 34 are shaped to extend in the front-rear direction. With the projections 31, 32 inserted in the recesses 88, 89, one flat surface (surface facing downward in FIG. 9) of the body portion 33 is in contact with an outer lateral part 92 of the recess 88, 89 and a clearance is formed between the other surface (surface facing upward in FIG. 9) of the body portion 33 and the projecting end surfaces of the ribs 34 and an inner lateral part 91 of the recess 88, 89 as in the first embodiment. Thus, also in the second embodiment, the mounting workability and shape stability of the sealing member 80 can be improved as in the first embodiment. Further, according to the second embodiment, the rigidity of the projection 31, 32 can be enhanced by the ribs 34.

[Other Embodiments of Present Disclosure]

The embodiments disclosed this time should be considered illustrative in all aspects, rather than restrictive.

In the case of the above embodiments (first and second embodiments), the projections are respectively provided on the housing and the protecting member. However, according to another embodiment, the respective projections may be provided only on either one of the housing and the protecting member. Similarly, in the case of the above embodiments (first and second embodiments), the recesses are respectively provided in the front and rear surfaces of the sealing member. However, according to another embodiment, the respective recesses may be provided only on the surface side facing the housing or protecting member provided with the respective projections.

In the case of the above embodiments (first and second embodiments), the projections are respectively formed to have the same shapes on the housing and the protecting member. However, according to another embodiment, the respective projections may be formed to have different shapes on the housing and the protecting member. Similarly, although the respective recesses are formed to have the same shapes in the front and rear surfaces of the sealing member, the respective recesses may be formed to have different shapes in the front and rear surfaces of the sealing member according to another embodiment.

In the case of the above embodiment (first embodiment), the terminal is configured as the module terminal. However, according to another embodiment, the terminal may be a general terminal entirely formed by a metal plate material without including any dielectric.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a terminal to be connected to a wire;

a housing for accommodating the terminal;

a pressing member to be mounted on the housing; and a sealing member to be arranged between the housing and the pressing member, wherein:

at least one of the housing and the pressing member has an inner peripheral surface to be held in close contact with an outer peripheral surface of the sealing member, the sealing member includes a sealing hole penetrating through front and rear surfaces, the wire being passed through the sealing hole in a liquid-tight manner, and a recess located closer to the outer peripheral surface than the sealing hole, the recess being open in at least one of the front and rear surfaces, at least one of the housing and the pressing member includes a projection to be arranged in the recess, and if, out of an inner wall of the recess in the sealing member, a part located on the side of the outer peripheral surface is an outer lateral part and a part located on the side of the sealing hole is an inner lateral part, a clearance is formed between the projection and the inner lateral part and the projection is arranged in contact with the outer lateral part in the recess.

2. The connector of claim 1, wherein the recess is shaped to extend along two side parts adjacent across a corner part of the sealing member.

3. The connector of claim 1, wherein the terminal is a module terminal including an inner conductor to be connected to the wire and a dielectric for covering an outer periphery of the inner conductor.

4. The connector of claim 3, wherein:

a general terminal having smaller external dimensions than the module terminal is accommodated in the housing and a general wire is connected to the general terminal, and the sealing member includes a general sealing hole penetrating from the front surface to the rear surface, the general wire being passed through the general sealing hole in a liquid-tight manner.

* * * * *